United States Patent [19]

de Jager

[11] Patent Number: 4,528,785

[45] Date of Patent: Jul. 16, 1985

[54] DISPLACEABLE ROOF STRUCTURE

[76] Inventor: Johannes A. de Jager, 13 Homan St., Ou Dorp, Klerksdorp, South Africa

[21] Appl. No.: 410,032

[22] Filed: Aug. 20, 1982

[51] Int. Cl.[3] ..... E04B 1/346

[52] U.S. Cl. ..... 52/66; 52/72

[58] Field of Search ..... 52/66, 72, 86, 64; 47/17, 30; 49/207

[56] References Cited

U.S. PATENT DOCUMENTS

| | | | |
|---|---|---|---|
| 1,106,624 | 8/1914 | Cadwallader et al. | 47/26 X |
| 2,094,801 | 10/1937 | Mass | 52/64 |
| 3,261,134 | 7/1966 | Crist | 52/86 X |
| 3,464,168 | 9/1969 | Russell et al. | 52/86 X |
| 4,062,146 | 12/1977 | Grossman et al. | 47/17 |
| 4,073,098 | 2/1978 | Baker | 52/66 |
| 4,175,361 | 11/1979 | Kumode | 52/66 |
| 4,381,629 | 5/1983 | Ahn | 52/66 |

FOREIGN PATENT DOCUMENTS

| | | | |
|---|---|---|---|
| 28222 | 8/1930 | Australia | 52/64 |
| 2445838 | 4/1976 | Fed. Rep. of Germany | 52/66 |
| 2282027 | 3/1976 | France | 52/66 |
| 0685784 | 9/1979 | Switzerland | 52/66 |
| 2044063 | 10/1980 | United Kingdom | 52/66 |

*Primary Examiner*—Carl D. Friedman

*Attorney, Agent, or Firm*—Parmelee, Bollinger and Bramblett

[57] ABSTRACT

The invention relates to a sun roof (10) which includes a plurality of roofing panels (28) supported on tracks in the form of track beams (20), the track beams forming part of a roof support structure and providing for the displacement of the panels relative to the structure. As such, the position of shade beneath the sun roof can be adjusted so as to provide for personal requirements.

11 Claims, 4 Drawing Figures

DISPLACEABLE ROOF STRUCTURE

This invention relates to roofing. More particularly, the invention relates to a sun roof for covering porches, verandahs, and the like.

The applicant is aware of various types of sun roofs which are presently used for covering porches, verandahs, and the like. A common disadvantage of these sun roofs is their permanent nature in that they provide shade only in specific areas depending on the position of the sun.

It is an object of this invention to provide a sun roof whereby shaded areas can be adjustably and selectively provided.

According to the invention there is provided roofing, which includes a roof structure supportable on a support structure; and at least one roofing sheet accommodated by and displaceable relative to the roof structure.

The roof structure may include guides, which guides provide for the displaceability of the or each roofing sheet. The guides for the or each roofing sheet may particularly include two opposing, parallel tracks between which the roofing sheet can be received and along which it is slidably displaceable when so received.

Conveniently, the or each roofing sheet may have castors located on opposite sides thereof, which run along the tracks of the particular sheet so that sliding displacement of the sheet along its tracks is thereby facilitated. Castors clearly include any like rollers, wheels, or the like.

In order to define an extended roof or sun roof, the roofing may include a plurality of roofing sheets. In one configuration, at least two of the roofing sheets may be disposed to be displaceable along parallel adjacent paths relative to the roof structure.

Alternatively, or in addition, at least two of the roofing sheets may be disposed to be displaceable overlappingly with one another, relative to the roof structure.

The roofing sheet may be of a sunfilter material. In particular, the roofing sheet may be of a metal or synthetic plastics gauze mounted in a suitable frame work to form an effective screen. Alternatively, the roofing sheet may be of a fibreglass laminate material including urethane foam as an insulator.

Still alternatively, the roofing sheet may be an opaque sheet of a metal, asbestos, synthetic plastics, or other suitable material.

Still alternatively, the roofing sheet may be a screen as defined above onto which an opaque sheet can be removably mounted. In this way filtered shade or absolute shade can be provided where required.

The invention also extends to roofing in accordance with the invention in combination with a support structure for supporting the roof structure. The support structure may particularly be adapted to co-operate with an existing wall, or like support, to support the roof structure. In one configuration the support structure may be an independent structure.

The support structure and the roof structure may be in the form of pillars and beams of a metal, timber, fibreglass or like material, providing sufficient rigidity to define a rigid support structure and roof structure.

Still further, the invention extends to a support structure particularly adapted to support roofing in accordance with the invention and to a roofing sheet particularly adapted for such roofing.

The invention is now described, by way of examples, with reference to the accompanying diagrammatic drawings.

Figure 1:
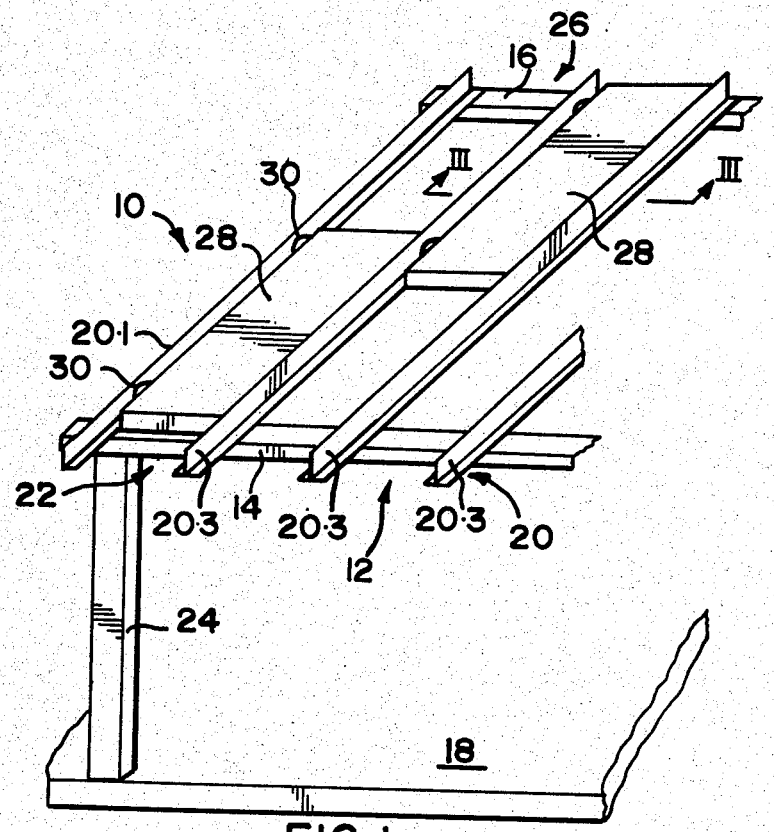
FIG. 1 is a three-dimensional view of a first embodiment of a portion of a sun roof for a verandah, in accordance with the invention.
Figure 2:
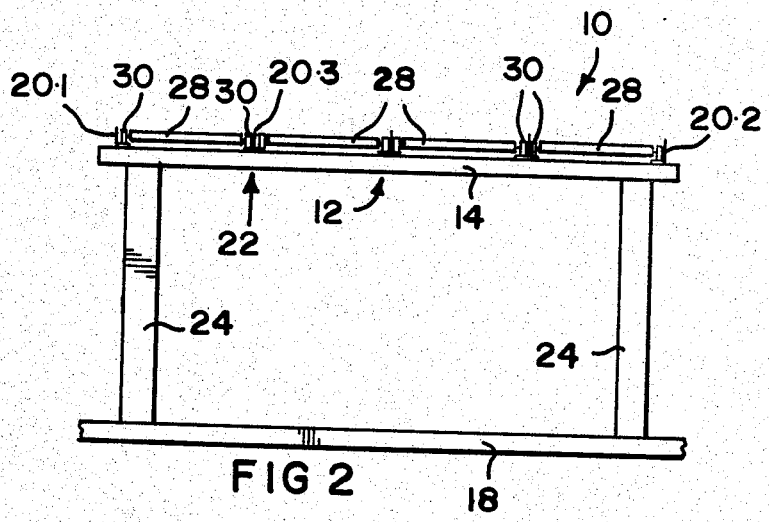
FIG. 2 shows a front elevation of the sun roof of FIG. 1.
Figure 3:
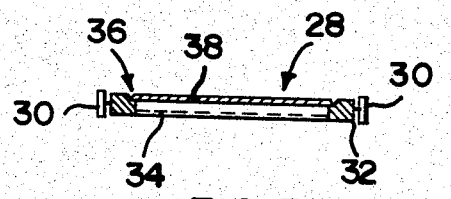
FIG. 3 shows a cross-sectional end view of a roofing sheet for the sun roof of FIG. 1 along line III—III of FIG. 1.

Referring to FIGS. 1 to 3 of the drawings a sun roof for a verandah, in accordance with the invention, is generally indicated by the reference numeral 10. The sun roof 10 includes a roof structure 12 comprising two longitudinally spaced cross beams 14 and 16 spanning the width of a verandah 18, and a plurality of track beams 20 extending longitudinally, transversely to the cross beams 14 and 16. The front end 22 of the structure 12 is supported on two pillars 24 whereas the rear end 26 of the structure 12 is supported by an existing wall (not shown) via the cross beam 16, in front of which wall the verandah 18 extends.

The track beams 20 comprise two opposing angle-iron sections 20.1 and 20.2 respectively at opposite ends of the sun roof 10, and intermediate inverted T-sections 20.3 between the angle-iron sections 20.1 and 20.2. All the beams 20 are parallel to and equally spaced from one another and define tracks upon which roofing panels 28 are receivable to be slidably displaceable along such tracks.

The roofing panels 28 extend along approximately one half of the length of the track beams 20 and are provided with rollers 30 secured to opposite sides of, the sheets 28 as shown. The rollers 30 facilitate the sliding displacement of the sheets 28 along the track beams 20.

The roofing panels 28 themselves comprise a rectangular framework 32 within which a gauze screen 34 of a metal or synthetic plastics material is secured. The top internal perimeter of the framework 32 has a recess 36 therein, within which an opaque sheet 38 is receivable. The sheet 38 may be of any suitable metal, synthetic plastics, asbestos, or the like, sheet material. Securing clips (not shown) are provided to hold the sheet 38 in position.

The track beams 20 are of a metal material or a synthetic plastics material whereas the cross beams 14 and 16 and the pillars 24 are of a metal, timber, synthetic plastics, glass fibre or like material.

By providing displaceable roofing panels 28, shaded areas on the verandah 18 can be adjustably and selectively provided. The panels 28 can be moved to meet the needs of persons for shade depending upon the position of the sun.

Furthermore, by removing the opaque sheet 38 from the roofing panels 28, the rays of the sun impinging on the screen are merely filtered and the intensity of the sun beneath the screen is reduced. This may be particularly useful for winter conditions when it may not be necessary to block out the sun completely from the verandah 18. The gauge of the gauze screen 34 will determine the intensity of the sun's rays to pass through the screen onto the verandah 18.

It will be understood that the sun roof 10 may include various other additional or alternative features while still remaining within the scope of the invention. For example, locating lugs or flanges may be provided along the track beams 20 to prevent the roofing panels 28 being lifted from their tracks by the wind. Similar lugs or flanges may also be provided to prevent the panels 28 being displaced beyond the front end 22 of the beams 20. The track beams themselves may also be of I- or H- section instead of the inverted T-section. The additional flange will perform the abovementioned function to prevent the roofing panels 28 being lifted from the tracks by the wind.

Figure 4:
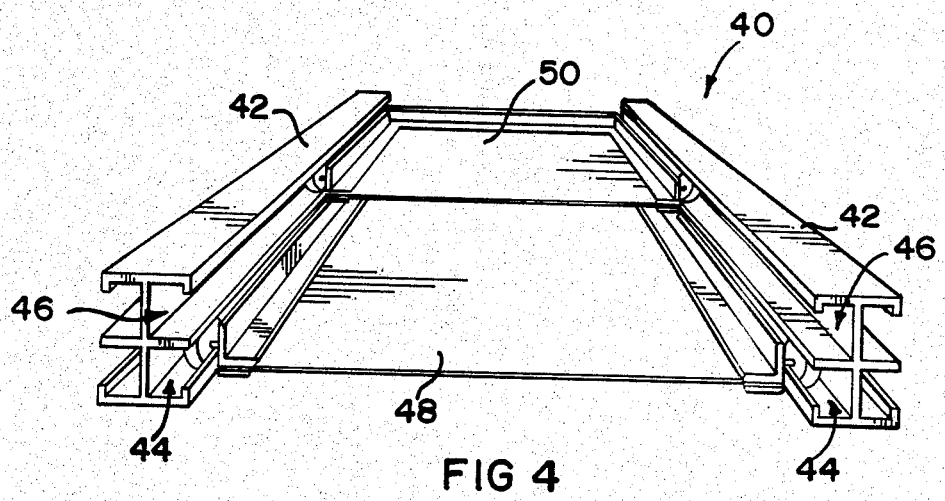
FIG. 4 shows a three-dimensional view of a portion of a second embodiment of a sun roof for a verandah, in accordance with the invention.

In a particular alternative embodiment of a sun roof, generally indicated by numeral 40 in FIG. 4, provision is made for track beams 42 which define two pairs of tracks 44 and 46 respectively, along which two separate roofing sheets 48 and 50 respectively are displaceable. The sheet 48 may then be of a fibreglass laminate material including urethane foam as insulator whereas the sheet 50 may be of a gauze material. Since the sheets 48 and 50 can overlap with one another, different degrees of shade can again be provided and, as such, the same results can be provided as for the arrangement 10 described above, without the need of having to insert or remove a sheet of opaque material as described above. A plurality of horizontally adjacent sheets can again be provided, as shown in FIG. 1 to form a complete sun roof using a similar structure 12 as described with reference to FIG. 1. Alternative support structures can clearly also be employed The sun roof 10, 40 may also form part of a separate structure adjacent a swimming pool or the like or any other structure which may require a roofing having displaceable roofing sheets.

The invention extends also to roof panels 28, 48, 50 displaceable along a roof structure as described.

I claim:

1. A sunshade, which includes:

a panel locating structure supportable on a support structure, a plurality of panels, including means for filtering sunlight, displaceably located within the panel locating structure to be positionable in arbitrary selected positions with respect thereto to provide shade beneath the sunshade, in its operative configuration, in selected regions only, each of said panels being movable relative to said panel locating structure independent of movement or position of any other of said panels within said panel locating structure, said panel locating structure including at least two adjacent pairs of opposing guides, said pairs being laterally displaced from one another; and at least one panel being displaceable between each pair of guides to be positionable in arbitrary selected positions with respect to said panel locating structure and laterally of a panel in an adjacent pair of guides to provide shade beneath the sunshade in said selected regions only.

2. A sunshade as claimed in claim 1 wherein each pair of guides includes at least one pair of opposed tracks along which said at least one panel is displaced between said guides.

3. A sunshade as claimed in claim 2, in which the panels have castors mounted on opposite sides thereof, which can run along the tracks to provide for the displacement of the panels.

4. A sunshade as claimed in claim 1, in which at least two panels are disposed within the panel locating structure to be overlapping displaceable with respect to one another.

5. A sunshade as claimed in claim 1, in which one or more of the panels are of a sunfilter material.

6. A sunshade as claimed in claim 5, in which one or more of the panels are of a gauze material mounted in a suitable framework.

7. A sunshade as claimed in claim 5, in which one or more of the panels are of a fiberglass laminate material including urethane foam as an insulator.

8. A sunshade as claimed in claim 1, in which one or more of the panels are of an opaque material.

9. A sunshade as claimed in claim 1, in combination with a support structure for supporting the panel locating structure in an overhead configuration.

10. A sunshade as claimed in claim 9, in which the support structure is an independent structure.

11. A panel particularly adapted for a sunshade as claimed in claim 1.

* * * * *